US007976402B2

(12) United States Patent
Chol

(10) Patent No.: US 7,976,402 B2
(45) Date of Patent: Jul. 12, 2011

(54) ADJUSTABLE LENGTH AND TORQUE RESISTANT GOLF SHAFT

(76) Inventor: Kim Chol, San Jose, CA (US)

( * ) Notice: Subject to any disclaimer, the term of this patent is extended or adjusted under 35 U.S.C. 154(b) by 0 days.

(21) Appl. No.: 12/785,429

(22) Filed: May 22, 2010

(65) Prior Publication Data

US 2010/0304881 A1 Dec. 2, 2010

Related U.S. Application Data

(60) Continuation-in-part of application No. 12/617,876, filed on Nov. 13, 2009, now abandoned, which is a continuation-in-part of application No. 12/491,050, filed on Jun. 24, 2009, now Pat. No. 7,874,932, which is a division of application No. 11/499,511, filed on Aug. 3, 2006, now Pat. No. 7,563,173.

(51) Int. Cl.
*A63B 53/16* (2006.01)

(52) U.S. Cl. ..... 473/296; 403/377

(58) Field of Classification Search ..... 473/239, 473/296, 298–299; 403/109.1–109.8, 377
See application file for complete search history.

(56) References Cited

U.S. PATENT DOCUMENTS

| | | | | |
|---|---|---|---|---|
| 1,648,806 | A | 5/1927 | Hadden | |
| 2,107,983 | A | 2/1938 | Hamilton | |
| 2,475,927 | A | 7/1949 | Verderber | |
| 5,452,891 | A | 9/1995 | Thomas | |
| D363,519 | S | 10/1995 | Gooden | |
| 5,653,644 | A | 8/1997 | Jaeckel | |
| 5,679,080 | A | 10/1997 | Finsterwald | |
| 6,776,724 | B1 | 8/2004 | Siemsglusz | |
| 7,018,302 | B2 | 3/2006 | Jacoby | |
| 7,422,526 | B2 | 9/2008 | Nemeckay | |
| 2002/0091012 | A1 * | 7/2002 | Evans | 473/296 |
| 2006/0028039 | A1 | 2/2006 | Ernesti | |

* cited by examiner

*Primary Examiner* — Stephen L. Blau
(74) *Attorney, Agent, or Firm* — Patent Office of Dr. Chung S. Park

(57) ABSTRACT

An adjustable golf shaft having an upper shaft member, a lower shaft member and an inner rod. The upper shaft member includes an elongated bore therein with an upper bushing fixed within an upper end of the elongated bore therein. The lower shaft member has an elongated bore therein with a middle bushing fixed within an upper end of the elongated bore therein. The inner rod includes a lower end dimensioned to be fixed to a lower bushing that can slide relative to the lower shaft member. The inner rod is adapted to slide within the middle bushing as the length of the shaft changes. The shaft also includes a fastener or locking mechanism, which secures the lower shaft member within the upper shaft member.

12 Claims, 13 Drawing Sheets

ADJUSTABLE LENGTH AND TORQUE RESISTANT GOLF SHAFT

CROSS-REFERENCE TO RELATED APPLICATIONS

This application is a continuation-in-part of U.S. patent application Ser. No. 12/617,876, which is a continuation-in-part of U.S. patent application Ser. No. 12/491,050, which is a divisional of U.S. patent application Ser. No. 11/499,511, which claims priority to U.S. Provisional Application No. 60/818,219, filed Jun. 30, 2006, which are incorporated herein in their entirety.

FIELD OF INVENTION

This invention relates to an adjustable golf shaft and more particularly to an adjustable length and torque resistant golf shaft for a golf putter.

BACKGROUND

The sport of golf is an increasingly popular sport. Much of the tension, and excitement, of any round of golf, surrounds the act of putting, which ordinarily determines the ultimate winner of any round of golf. As a result of its obvious importance to successfully playing the game of golf, the art, or skill, of putting has been the subject of large numbers of instruction manuals, books, magazine articles, and United States patents. A casual observation of professional and amateur golfers, in the acts of putting shows that putting style, including putter grip, player's stance, putter club style, ball position, can be different for each golfer.

In addition, it can be appreciated that physically, every golfer varies greatly in height, weight, and body structure, such that the distance and angle between the ground and the golfer's hands when putting can also vary greatly. Generally speaking, the act of putting does not require unusual strength, or extremely high velocity club swinging, as in the case of driving or iron play. Putting is, rather, an act of finesse and, hopefully, an act as free of physical stress and mental swing correction signals as possible.

Golf clubs available for purchase at most sports stores are readily available in varying degrees of shaft flex and club head shape. The length of the woods and irons of a set of golf clubs are usually approximately standard throughout the golf manufacturing industry, although such clubs may be special ordered with non-standard lengths. Most golfers, however, acquire a standard length set of clubs and modify their stance, grip, and other swing characteristics to optimize their swing action relative to those clubs.

The design of putters is typically viewed as a pursuit of an aesthetically pleasing club that promotes a golfer's confidence in his or her stroke. As such, many putters have been designed irrespective of the mechanics inherent in the putting swing. Furthermore, many putters lack a design that accounts for an individual golfer's characteristics and characteristic playing style (i.e., stance, grip, etc.).

In the case of putters, conventional practice is to provide putters having an overall length of generally about 35", and a conventional lie angle between the shaft and the bottom surface of the putter of approximating 70 degrees. Rarely are putters shortened or lengthened, and typically, the beginner, or intermediate, golfer will adapt his putter swing to the length of the club rather than having a putter personally fitted to him, or her, without any reference to the standard length or lie.

Accordingly, it would be desirable to have a putter with an adjustable length and torque resistant golf shaft, which can easily adjust to various heights and has the appearance of a conventional shaft whose configuration is fixed.

SUMMARY

In accordance with one embodiment, an adjustable golf shaft comprises: an upper shaft member having an elongated bore therein with a fixed upper bushing positioned within an upper end of the elongated bore therein; a lower shaft member having an elongated bore therein with a middle bushing fixed within an upper end of the elongated bore therein, the middle bushing having an elongated bore extending through the middle bushing; a helical inner rod having a lower bushing fixed to a lower end thereof, the bore of the middle bushing having a helical shape to accommodate the inner rod therethrough and to move the middle bushing relative to the upper bushing upon rotating the helical inner rod within the middle bushing; and a locking mechanism adapted to prevent the helical inner rod from rotating within the middle bushing, to thereby fix a total length of the shaft.

DETAILED DESCRIPTION

Figure 1:
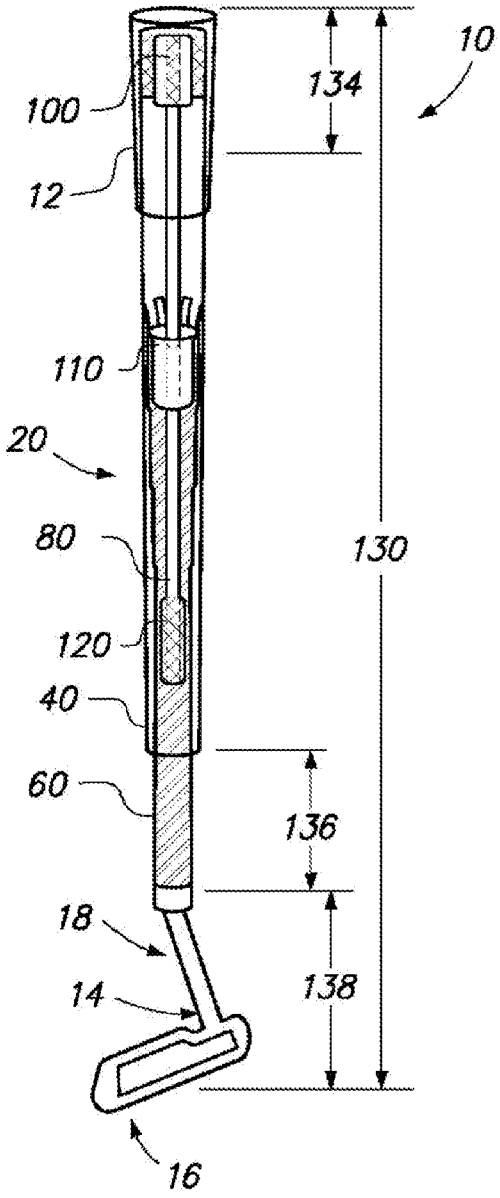
FIG. 1 is a cross sectional view of an adjustable length and torque resistant golf shaft according to one embodiment.

FIG. 1 is a cross sectional view of a putter 10 having an adjustable length and torque resistant golf shaft 20 according to one embodiment. As shown in FIG. 1, the putter 10 includes an adjustable shaft 20, which is comprised of an upper shaft member 40 (or outer shaft member), a lower shaft member 60 (or inner shaft member) and an inner rod 80. The shaft 20 includes an upper bushing 100 fixed within the upper shaft member 40, a middle bushing 110 fixed within the lower shaft member 60 and a lower bushing 120 fixed to the inner rod 80. The putter 10 also includes a grip 12 and a putter head 14. The grip 12 is configured to fit over an upper end of the upper shaft member 40 and extends downward approximately 8 to 14 inches. The inner rod 80 is configured to fit within the upper and lower shaft members 40, 60.

As shown in FIG. 1, the putter 10 preferably has an overall length 130 of between about 27 and 37 inches. The overall length 130 of the putter 10 when fully extended is approximately 37 inches. Meanwhile, the overall length 132 of the putter in a compressed or compact position is preferably approximately 27 inches. Although, the preferable overall length 130 of the putter 10 is between 27 and 37 inches, it can be appreciated that the overall length 130 of the putter can range from 10 to 72 inches and is more preferably between 20 and 44 inches, and most preferably between 27 and 37 inches. The overall length 130 of the putter 10 varies by a differential length 134, 136 of preferably about 10 inches. As shown, the overall length 130 of the putter 10 includes the adjustable shaft 20 and a putter head 14. Typically, putter heads 14 have an overall height 138 of approximately 3 inches, which includes the putter head or ball striking portion 16 and a shaft 18. The shaft 18 extends from the putter head or ball striking portion 16 to the adjustable shaft 20. It can be appreciated that the overall length 130 of the putter 10 can vary and that any reference to specific measurements is for one embodiment of the present invention consisting of a putter 10 having an overall length of between 27 and 37 inches. However, it can be appreciated that the various dimensions, length, diameters and other specific references to any specific measurement can be changed without departing from the present invention.

Figure 2:
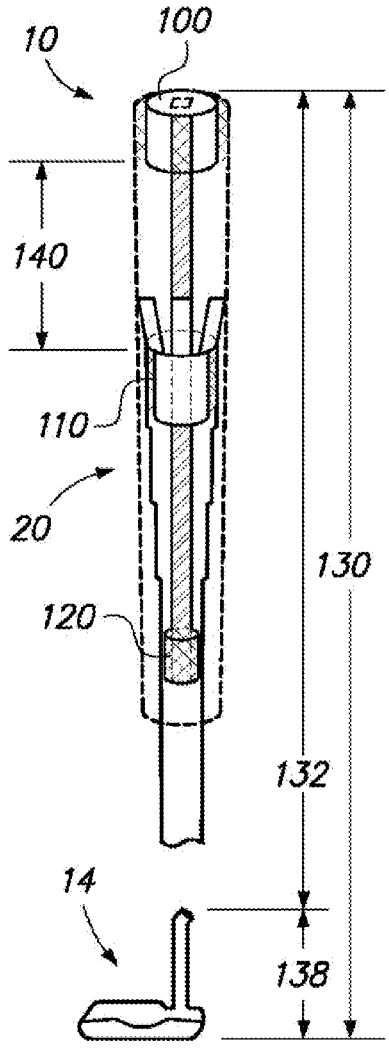
FIG. 2 is a cross sectional view of the adjustable length and torque resistant golf shaft of FIG. 1 in an extended position.

FIG. 2 is a cross sectional view of the adjustable length and torque resistant golf shaft 20 of FIG. 1 in a fully extended position. As shown in FIG. 2, the shaft 20 in the fully extended position has an overall length 130 in accordance with one embodiment of approximately 37 inches, which includes the putter head 14. The putter head 14 will typically have an overall length 138 of approximately 3 inches. Furthermore, the adjustable shaft 20 has an overall length 132 of between 24 and 34 inches from the fully compressed or compacted position to the fully extended position.

Figure 3:
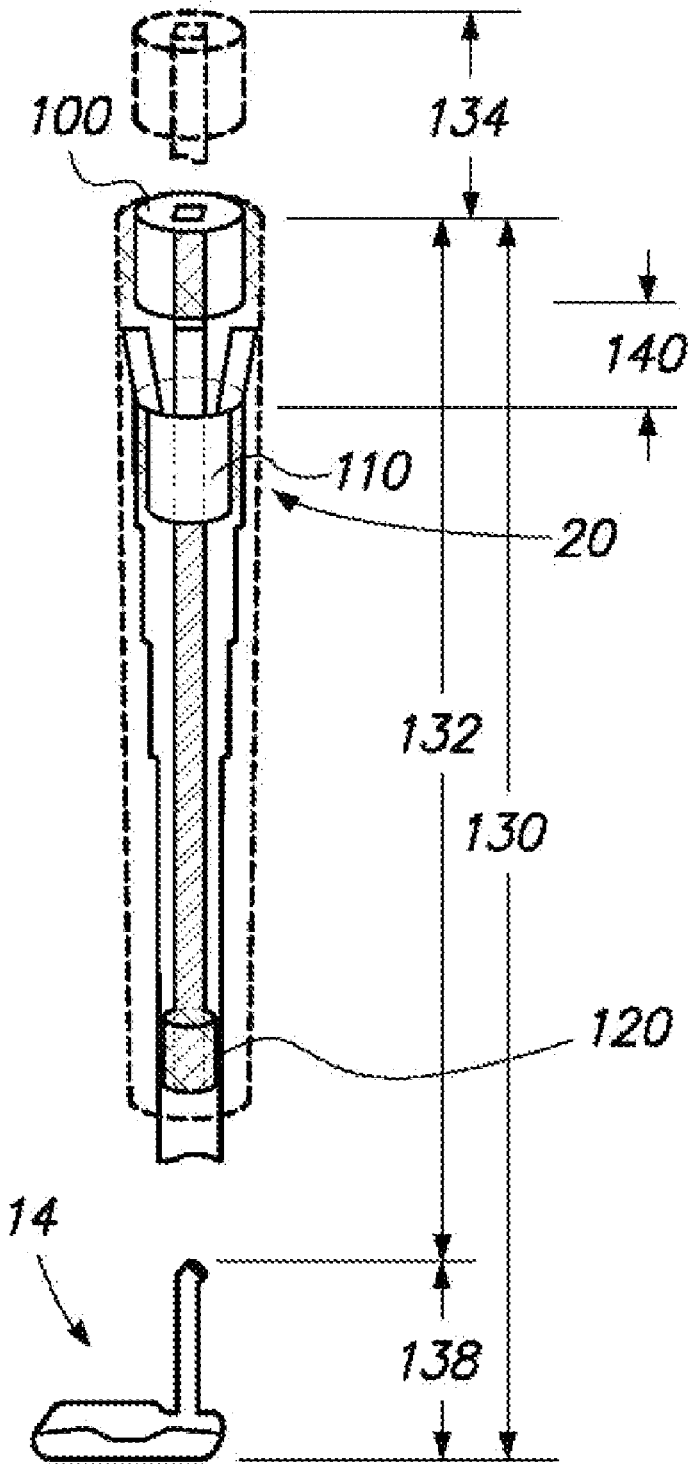
FIG. 3 is a cross sectional view of the adjustable length and torque resistant golf shaft of FIG. 1 in a compressed position.

FIG. 3 is a cross sectional view of the adjustable length and torque resistant golf shaft 20 of FIG. 1 in a fully compressed or compacted position. As shown in FIG. 3, the shaft 20 compresses to an overall length 132 of approximately 24 inches in a preferred embodiment, and an overall length 130 of 27 inches including the putter head 14. The difference 134 between the extended position and the compressed or compact position is typically approximately 10 inches; however, it can be appreciated that the difference 134 can be more or less than 10 inches. As shown in FIG. 3, as the adjustable shaft 20 is compressed and/or extended, the distance 140 between the upper bushing 100 and the middle bushing 110 changes. For example, as the shaft 20 extends, the distance 140 between the upper bushing 100 and the middle bushing 110 increases. Alternatively, as the shaft 20 is compressed, the distance 140 between the upper bushing 100 and the middle bushing 110 decreases.

Figure 4:
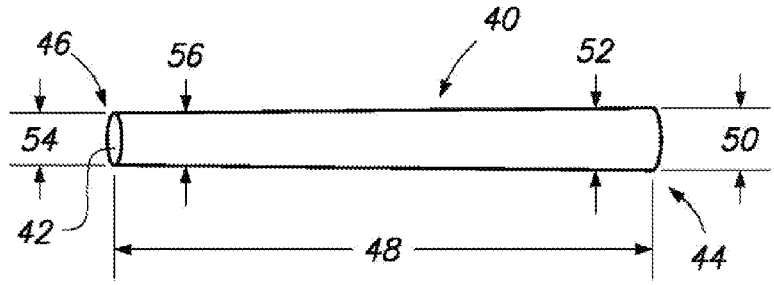
FIG. 4 is a perspective view of an upper shaft member of an adjustable length and torque resistant golf shaft.

FIG. 4 is a perspective view of an upper shaft member 40 of an adjustable length and torque resistant golf shaft 20. As shown in FIG. 4, the upper shaft member 40 is comprised of an essentially elongated cylindrical bore 42 having an upper end (or first end) 44 and a lower end (or second end) 46. The upper shaft member 40 has an overall length 48 of approximately 24 inches for a putter 10 having an overall length 130 of between 27 and 37 inches. The upper end 44 of the upper shaft member 40 preferably has an inner diameter 50 and an outer diameter 52 of approximately 0.550 and 0.580 inches, respectively. The lower end 46 of the upper shaft member 40 preferably has an inner diameter 54 and an outer diameter 56 of approximately 0.370 and 0.400 inches.

Figure 5:
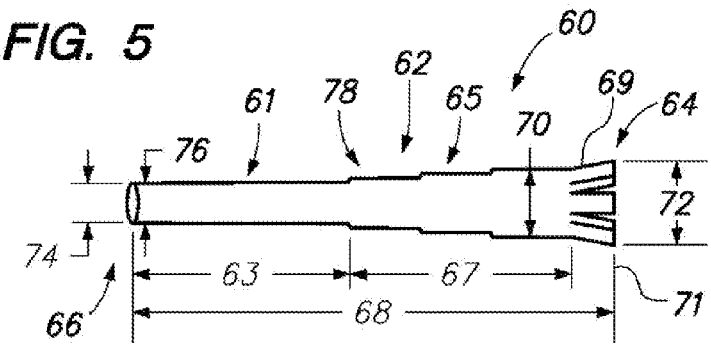
FIG. 5 is a perspective view of a lower shaft member of an adjustable length and torque resistant golf shaft.

FIG. 5 is a perspective view of a lower shaft member 60 of an adjustable length and torque resistant golf shaft 20. As shown in FIG. 5, the lower shaft member 60 is comprised of an essentially elongated cylindrical bore 62 having an upper end (or first end) 64 and a lower end (or second end) 66. The lower shaft member 60 can also include a stepped outer surface 78. The lower shaft member 60 includes a generally cylindrical lower portion 61, which extends for a distance 63 of approximately 12.5 inches, and an upper portion 65, which extends for a distance 67 of approximately 9 inches. The upper portion 65 has an outer diameter, which can increase in diameter in a series of annular steps. Each of the annular steps is preferably between 1 to 3 inches, and more preferably between 1.5 and 2.5 inches. Alternatively, it can be appreciated that the upper portion 65 can be configured without the stepped outer surface 78.

On the upper end 64 of the lower shaft member 60, the end 64 is flared and includes a plurality of flared members 69. The flared members 69 extend a distance 71 of approximately 0.5 inches. The lower shaft member 60 has an overall length 68 of approximately 22 inches for a putter 10 having an overall length 130 of between 27 and 37 inches. The upper end 64 of the lower shaft member 60 preferably has an inner diameter 70 and an outer diameter 72 of approximately 0.420 and 0.560 inches, respectively. The lower end 66 of the lower shaft member 60 preferably has an inner diameter 74 and an outer diameter 76 of approximately 0.320 and 0.365 inches. As shown in FIGS. 1 and 2, the upper end 64 of the lower shaft member 60 fits within the lower end 46 of the upper shaft member 40. As the shaft 20 extends in length, the lower shaft member 60 telescopes outward from the upper shaft member 40.

Figure 6:
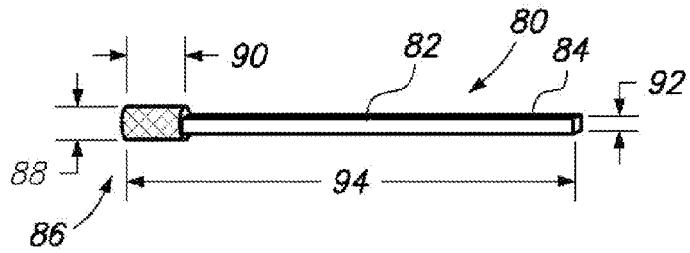
FIG. 6 is a perspective view of an inner rod with a plurality of bushings for an adjustable length and torque resistant golf shaft.

FIG. 6 is a perspective view of an inner rod 80 with a lower bushing 120 for an adjustable length and torque resistant golf shaft 20. As shown in FIG. 6, the inner rod 80 is comprised of a generally rectangular or square rod 82 having an upper end or first end 84 and a lower end or second end 86. On the lower end 86 of the rod 82, a lower bushing 120 is fixed thereto. The lower bushing 120 is generally cylindrical in shape and has an outer diameter 88 of approximately 0.240 inches and an overall length 90 of approximately 1.0 inches. The rod 82 can have any suitable cross sectional configuration and preferably has a thickness 92 of approximately 0.125 inches for a rectangular or square rod. The rod 82 preferably has an overall length 94 of approximately 16 to 24 inches, and more preferably an overall length 94 of 18 to 22 inches, and most preferably an overall length 94 of 22 inches. The rod 82 is preferably fixed to the upper and lower bushings 100, 120 and is allowed to slide upwards and downwards within an opening or bore 112 extending through a center portion the middle bushing 110.

Figure 7A:
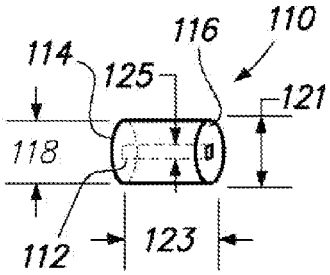
FIG. 7A is a perspective view of a middle bushing.

FIG. 7A is a perspective view of the middle bushing 110. As shown in FIG. 7, the middle bushing 110 is generally cylindrical in shape and includes an opening or bore 112 extending from a first end 114 to a second end 116. The first end 114 of the middle bushing has an outer diameter 118 of approximately 0.410 inches and an outer diameter 121 at the second end 116 of approximately 0.440 inches. The middle bushing 110 has an overall length 123 of approximately 1.0 inches. The opening or bore 112 preferably has a cross section configuration or diameter 125, which is essentially similar to that of the rod 82 of the inner rod 80. For example, for a square rod 82 having an outer diameter of 0.125 inches, the diameter 125 of the opening or bore 112, will preferably be approximately 0.125 inches or slightly larger to allow the rod to slide within the opening or bore 112 as the shaft 20 is extended or compressed.

Figure 7B:
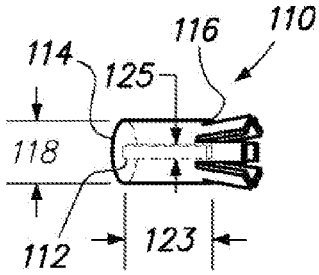
FIG. 7B is a perspective view of an alternative embodiment of the middle bushing.

FIG. 7B is a perspective view of an alternative embodiment of a middle bushing 110. The middle bushing 110 is generally cylindrical in shape and includes an opening or bore 112 extending from a first end 114 to a second end 116. The second end 116 of the bushing 110 as shown in FIG. 7B preferably includes a plurality of flared members 69. In addition, the opening or bore 112 preferably has a cross section configuration or diameter 125, which is essentially similar to that of the rod 82 of the inner rod 80.

Figure 8:
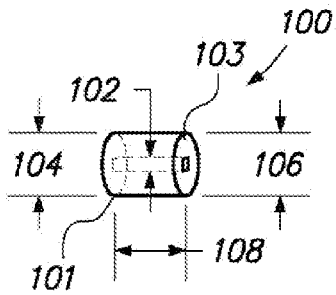
FIG. 8 is a perspective view of an upper bushing.

FIG. 8 is a perspective view of an upper bushing 100. As shown in FIG. 8, the upper busing 100 is generally cylindrical in shape and includes an opening or bore 102 extending from a first end 101 to a second end 103. The first end 101 of the upper bushing 100 has an outer diameter 104 of approximately 0.540 inches and an outer diameter 106 at the second end 103 of approximately 0.540 inches. The upper bushing 100 has overall length 108 of approximately 1.0 inches. As shown in FIG. 1, the upper bushing 100 is preferably fixed in the vicinity of the upper end of 44 of the upper shaft member 40.

Figure 9:
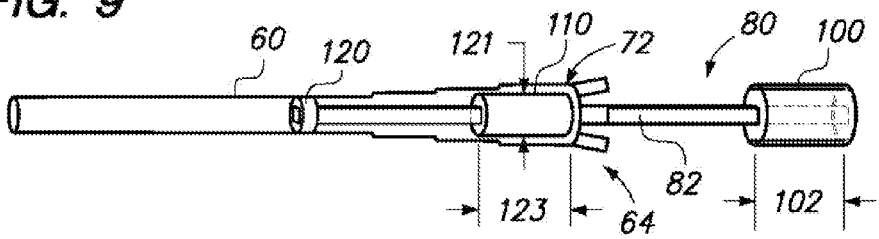
FIG. 9 is a perspective view of the lower shaft member and the inner rod.

FIG. 9 is a perspective view of the lower shaft member 60 and the inner rod 80. As shown in FIG. 9, the middle bushing 110 is fixed within an inner diameter 72 of the lower shaft member 60 near the upper end 64 with a suitable adhesive. The middle bushing 110 is fixed to the inner diameter 72, such that the rod 82 of the inner rod 80 can move freely in an up and down motion during expansion or compression of the shaft 20. In addition, it can be appreciated that as a result of the configuration of the opening or bore 112, the inner rod 80 does not rotate within the middle bushing 110. It can be appreciated that as a result of the locking configuration of the opening or bore 112 and the cross sectional configuration of the rod 82, the shaft 20 includes an anti-torquing or torque resistant feature. Furthermore, the inability of the rod 80 to rotate in connection with the inability of the upper and lower shaft members 40, 60 to rotate within the opening or bore 112 of the middle bushing 110, the shaft is torque resistant.

Figure 10:
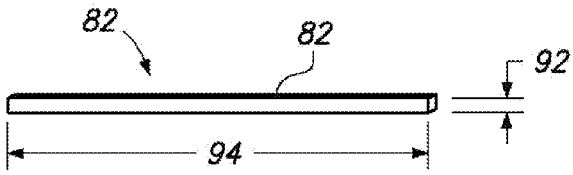
FIG. 10 is a perspective view of the inner rod.

FIG. 10 is a perspective view of the rod 82 portion of the inner rod 80. As shown in FIG. 10, the inner rod 80 includes a rod 82 having an overall length 94 of approximately 18 inches with a generally rectangular or square cross section 92.

Figure 11A:
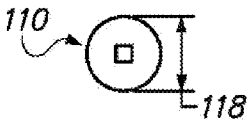
FIGS. 11A-11D are cross sectional views of a series of lower bushings adapted to receive an inner rod having various cross sectional configurations.
Figure 11B:
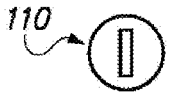
Figure 11C:
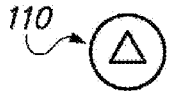
Figure 11D:
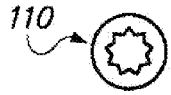

FIGS. 11A-11D are cross sectional views of a series of middle bushings 110 adapted to receive an inner rod 82 having various cross sections. As shown in FIGS. 11A-11D, it can be appreciated that the opening or bore within the middle bushing 110 can have any suitable configuration to match that of the rod 82 including square (FIG. 11A), rectangular (FIG. 11B), triangular (FIG. 11C) or star (FIG. 11D).

Figure 12A:
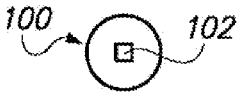
FIGS. 12A-12D are cross sectional views of a series of upper bushings adapted to receive an inner rod having various cross sectional configurations.
Figure 12B:
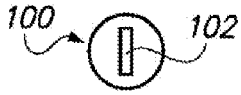
Figure 12C:
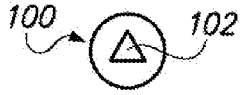
Figure 12D:
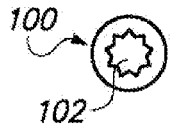

FIGS. 12A-12D are cross sectional views of a series of upper bushings 100 adapted to receive an inner rod 82 having various cross sections. As shown in FIGS. 12A-12D, it can be appreciated that the opening or bore 102 within the upper bushing 100 can have any suitable configuration to match that of the rod 82 including square (FIG. 12A), rectangular (FIG. 12B), triangular (FIG. 12C) or star (FIG. 12D).

Figure 13A:
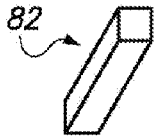
FIGS. 13A-13D are cross sectional views of a series of an inner rod having various cross sectional configurations.
Figure 13B:
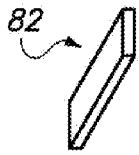
Figure 13C:
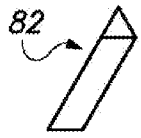
Figure 13D:
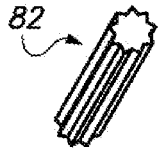

FIGS. 13A-13D are cross sectional views of a series of an inner rod 80 having various cross sectional configurations. As shown in FIGS. 13A-13D, it can be appreciated that the rod 82 can have any suitable cross sectional configuration to match that of the rod opening or bore within the upper and middle bushings 100, 110 including square (FIG. 13A), rectangular (FIG. 13B), triangular (FIG. 13C) or star (FIG. 13D).

Figure 14:
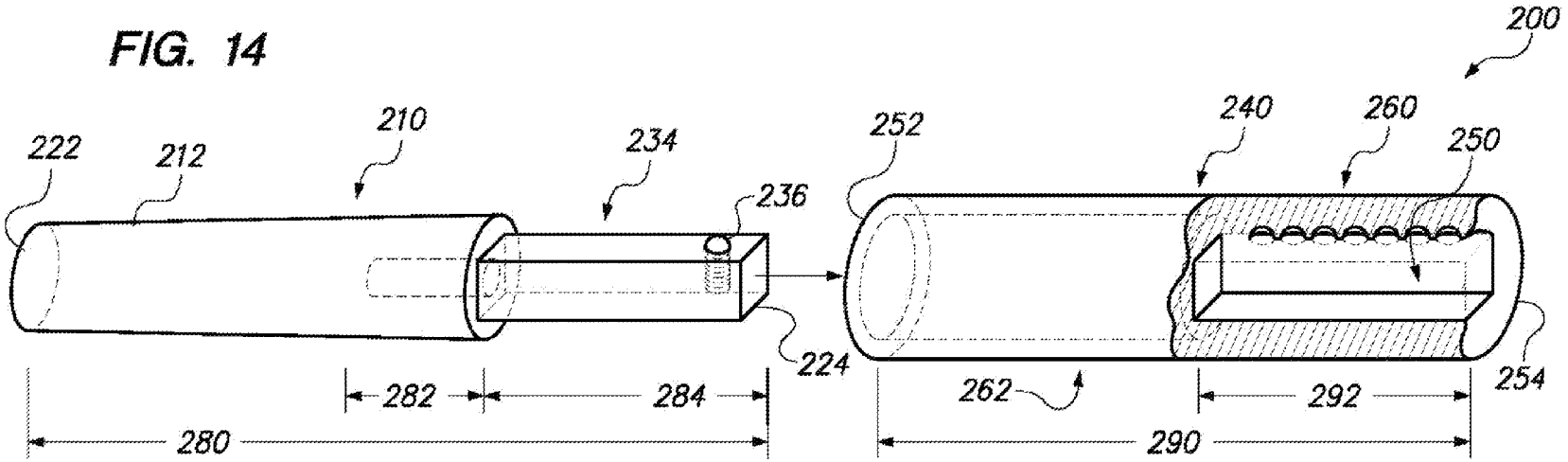
FIG. 14 is a perspective view of an adjustable length and torque resistant golf shaft according to another embodiment.

FIG. 14 is a perspective view of an adjustable length and torque resistant golf shaft 200 according to another embodiment. As shown in FIG. 14, the adjustable golf shaft 200 includes a lower shaft member 210 (or inner shaft member) and an upper or outer shaft member 240 (or outer shaft member). The lower shaft member 210 is comprised of an elongated cylindrical bore 212 with an inner rod member 220 attachable thereto. The upper shaft member 240 is comprised of an elongated outer cylindrical bore 262, which houses or contains an elongated cylindrical member 260 having an inner bore 250. The inner bore 250 is dimensioned to receive the inner rod member 220. The inner rod member 220 and the inner bore 250 are dimensioned to prevent the inner rod member 220 from rotating within the inner bore 250 forming a torque resistant golf shaft 200.

As shown in FIG. 14, the lower shaft member 210 is comprised of an essentially elongated cylindrical bore 212 having an upper end (or first end) 214 and a lower end (or second end) 216. The upper end or first end 214 of the cylindrical bore 212 is configured to receive the inner rod member 220. The inner rod member 220 includes a lower portion 232 and an upper portion 234. The upper portion 234 is configured or dimensioned to fit within the inner bore 250 of the upper shaft member 240. The lower portion 232 is configured or dimensioned to be received within the first end or upper end 214 of the elongated cylindrical bore 212. Overall, the inner shaft member 210 preferably extends for a distance 280 of approximately 15 to 30 inches and more preferably approximately 20 to 25 inches and most preferably approximately 22.50 inches with the upper shaft member 240 preferably extending for a distance of 290 of approximately 15 to 30 inches and more preferably approximately 20 to 25 inches and most preferably approximately 23.25 inches.

It can be appreciated that the lower shaft member 210 can also include a stepped or angled outer surface 216, wherein elongated cylindrical bore 212 preferably having a greater diameter at the upper or first end 214 as compared to the lower or second end 216. As shown in FIG. 14, the lower shaft member 210 includes a generally cylindrical lower portion 211, which extends for a distance 213 of approximately 19.0 inches, and an upper portion 215 of the lower shaft member 210, which extends for a distance of 284 of approximately 3.5 inches. The upper portion 215 of the lower shaft member 210 typically coincides with the upper portion 234 of the inner rod 220. However, it can be appreciated that the upper portion 234 of the inner rod member 220 can be configured to fit within the lower portion 211 of the elongated cylindrical bore 212. The elongated cylindrical bore 212 also includes a lower end or putter head end 222 dimensioned to receive a putter head shaft (not shown). As shown in FIG. 14, the inner rod member 220 includes a lower portion 232 dimensioned to be received within the upper end 214 of the lower bore member 212, and an upper portion 234 dimension to be received within an inner bore 250 of the inner bore member 260 of the upper shaft member 240.

The upper shaft member 240 is comprised of an elongated outer cylindrical bore 262, which houses an elongated cylindrical member 260 having an inner bore 250. The inner bore 250 is dimensioned to receive the inner rod member 220. As assembled, the inner rod member 220 and the inner bore 250 are dimensioned to prevent the inner rod member 220 from rotating within the inner bore 250 forming a torque resistant golf shaft 200. The upper shaft member 240 includes a lower end 252, which is configured to receive the inner rod member 220 of the lower shaft member 210 and an upper end 254. The upper end 254 preferably includes a handgrip (not shown), which circumscribes the upper most portion of the adjustable golf shaft 200. As shown in FIG. 14, the elongated outer cylindrical bore 262 extends from the lower end 252 to the upper end 254 for a distance 290 of approximately 15 to 30 inches and more preferably approximately 17.5 to 25 inches and most preferably about 23.25 inches. The elongated cylindrical member 260 is housed within the upper portion of the upper shaft 240. The elongated cylindrical member 260 preferably has a length 292 of approximately 10 to 18 inches and more preferably a length 292 of approximately 14.0 inches.

Figure 15:
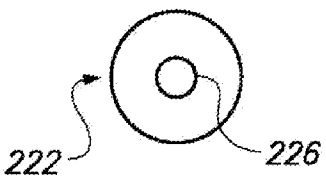
FIG. 15 is a cross sectional view of the lower end of lower shaft member of the adjustable length and torque resistant golf shaft of FIG. 14.

FIG. 15 is a cross sectional view of the lower end 216 of the lower shaft member 210 of the adjustable length and torque resistant golf shaft 200 of FIG. 14. As shown in FIG. 15, the lower end 216 of the lower shaft member 210 includes an opening or bore 226, which is dimensioned to receive a putter head shaft 18 (FIG. 1) of a putter head 14. It can be appreciated that the putter head 14 typically includes the putter head shaft 18 and a ball striking member 16.

Figure 16:
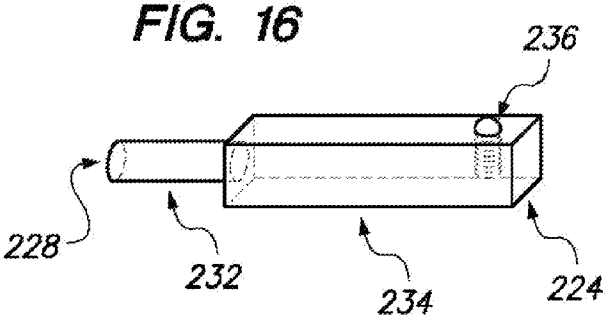
FIG. 16 is a perspective view of the inner rod of the lower shaft member of the adjustable length and torque resistant golf shaft of FIG. 14.

FIG. 16 is a perspective view of the inner rod member 220 of the lower shaft member 210 of the adjustable length and torque resistant golf shaft 200 of FIG. 14. As shown in FIG. 16, the inner rod member 220 includes a lower portion 232 and an upper portion 234. The lower portion 232 is preferably a cylindrical member 233 or other suitable shape having a cross sectional shape, which is configured to be fixed within an upper end 214 of the lower portion 211 of the lower shaft member 210. The upper portion 234 of the inner rod member 220 is dimensioned to be received within the inner bore 250 of the inner bore member 260 of the upper shaft member 240. The upper portion 234 and the inner bore 250 preferably having complimentary cross sectional configurations, wherein the upper portion 234 of the inner rod member 220 is configured to fit within the inner bore 250 in such a manner that the lower shaft member 210 does not rotate within the upper shaft member 240. The upper portion 234 of the inner rod member 220 also preferably includes a spring member 236 preferably having a ball mounted member 238 attached thereto, wherein the spring member 236 is configured to fit within the inner bore 250 of the upper shaft member 240. It can be appreciated that the spring member 236 can be replaced with any suitable device or system, which secures the inner rod member 220 within the inner bore 250 of the upper shaft member 240.

Figure 17:
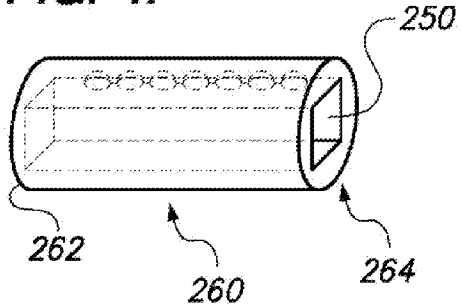
FIG. 17 is a perspective view of the inner bore member within the upper shaft member of the adjustable length and torque resistant golf shaft of FIG. 14.

FIG. 17 is a perspective view of the inner bore member 260 within the upper shaft member 240 of the adjustable length and torque resistant golf shaft 200 of FIG. 14. As shown in FIG. 17, the elongated cylindrical member 260 includes an inner bore 250, which is dimensioned to receive the upper portion 234 of the inner rod member 220 (FIG. 16). The elongated cylindrical member 260 is preferably positioned within an upper portion of the upper shaft member 240. The inner bore 250 can also include a series of ridges 270 having an upper portion 272 and a lower portion 274, which configured to receive the spring member 236 of the inner rod member 220. The series of ridges 270 allows the lower shaft member 210 and the inner rod member 220 to fit within the upper shaft member 240 and the inner bore 250, respectively, such that the lower shaft member 210 slides within the upper shaft member 240 during extension and compression of the shaft 200. The elongated cylindrical member 260 has a first end 262 and a second end 264, wherein a distance 292 from the first end 262 to the second end 264 is preferably approximately 14.0 inches long.

FIGS. 18A-18E are cross sectional views of a series of the inner rod member 220 of the lower shaft member 210 and the inner bore 250 within the upper shaft member 240. As shown in FIGS. 18A-18E, the inner bore 250 is configured to receive the upper portion 234 of the inner rod member 220 having various cross sectional configurations.

Figure 18A:
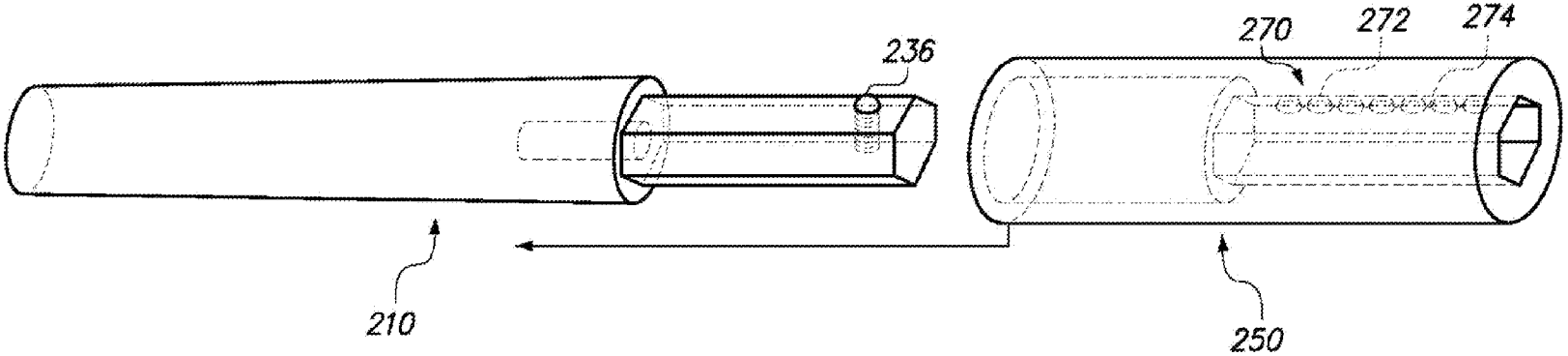
FIGS. 18A-18E are cross sectional views of a series of the upper portion of the inner rod member and the inner bore within the upper shaft member having various cross sectional configurations.
Figure 18B:
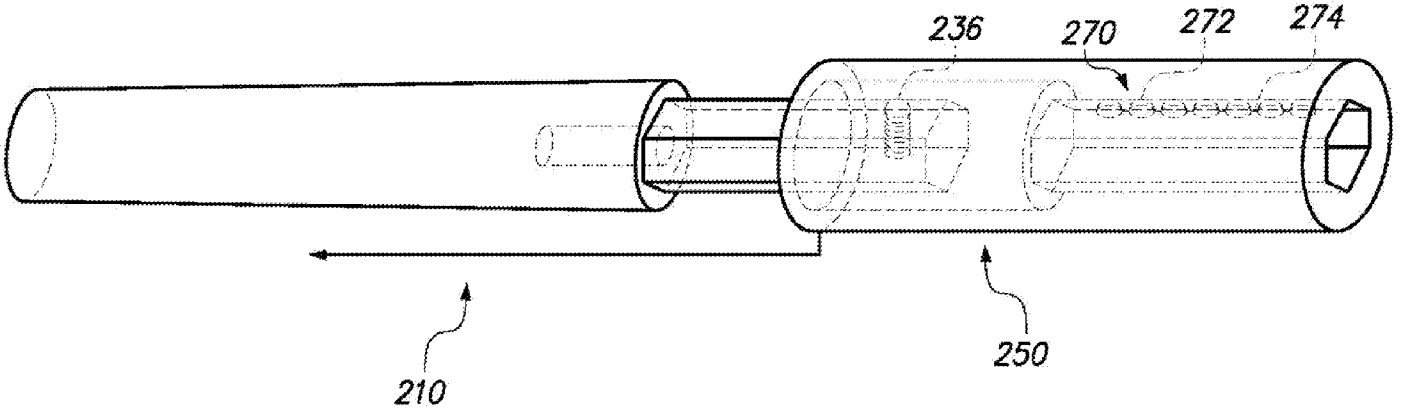
Figure 18C:
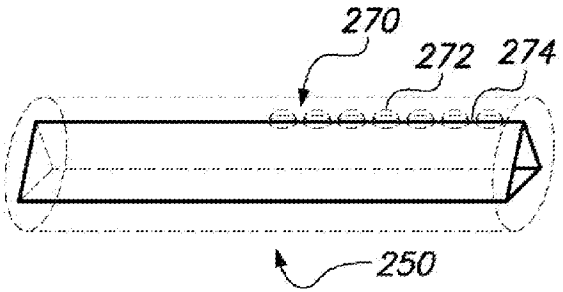
Figure 18C:
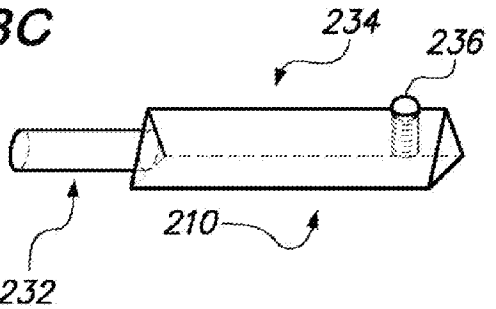
Figure 18D:
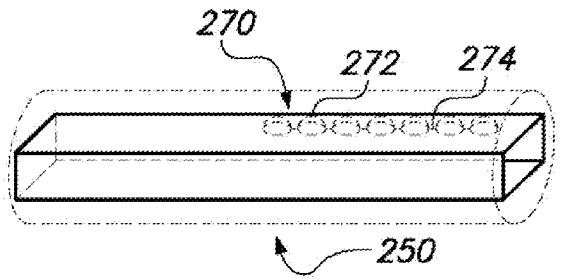
Figure 18D:
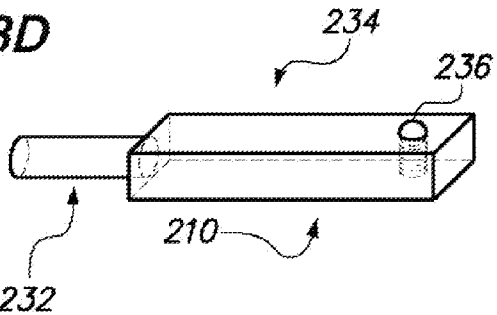

FIG. 18A shows a perspective view of the adjustable shaft member 200, including the lower shaft member 210 and the inner rod member 220, and the upper shaft member 240 and the elongated cylindrical member 260 and the inner bore 250. As shown in FIG. 18A, the inner rod member 220 and the inner bore 250 are complementary, such that the inner rod member 220 and the lower shaft member 210 does not rotate during use. In addition, the inner rod member 220 includes a spring member 236, which provides tension between inner rod member 220 and the inner bore 250 to prevent the lower shaft member 210 from sliding within the upper shaft member 240 during use.

Figure 18E:
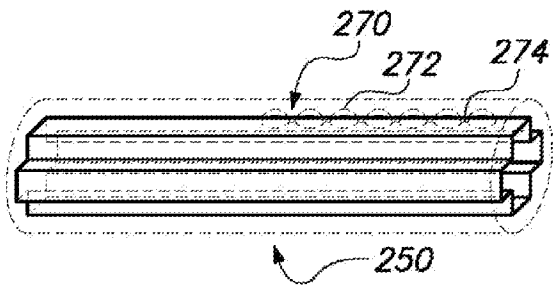
Figure 18E:
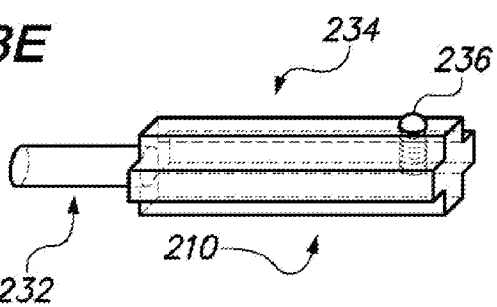

FIGS. 18B-18E are a series of perspective views of the inner rod member 220 and the inner bore 250 having various cross-sectional configurations. As shown in FIGS. 18B-18E, any suitable cross-sectional configuration can be used including a hexagon-like cross section (FIG. 18B), triangular (FIG. 18C), rectangular or square (FIG. 18D), or cross-like (FIG. 18E).

Figure 19:
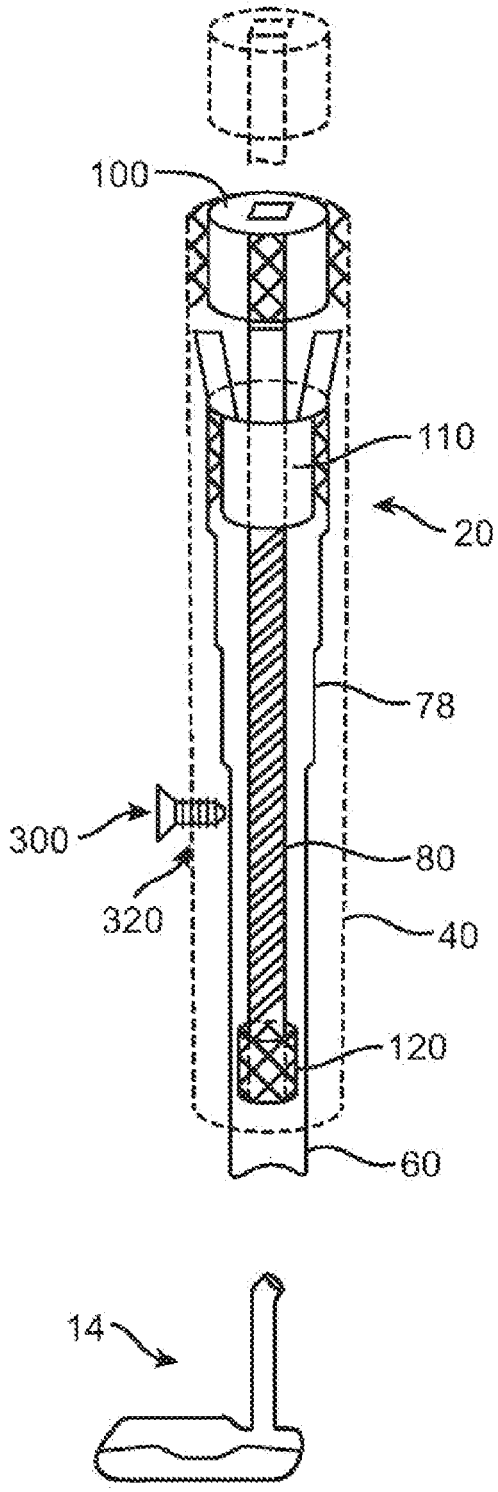
FIG. 19 is a cross sectional view of the adjustable length and torque resistant golf shaft of FIG. 1 in a compressed position in accordance with another exemplary embodiment.

FIG. 19 is a cross sectional view of the adjustable length and torque resistant golf shaft of FIG. 1 in a fully compressed or compacted position. As shown in FIG. 19, the shaft 20 includes an upper bushing 100 fixed within the upper shaft member 40, a middle bushing 110 fixed within the lower shaft member 60, a lower bushing 120 fixed to the inner rod 80, and a fastener 300, preferably in the form of a screw or other suitable device, which fits within an opening or hole 320 within the shaft 20. The fastener or screw 300 secures the length of the shaft 20 upon ascertainment of a desired length for use. As shown in FIG. 19, the lower shaft member 60 has a stepped outer surface 78, which assists with securing the shaft upon the determination of the desired length and with preventing the lower shaft member 60 from rotating within the upper shaft member 40.

Figure 20A:
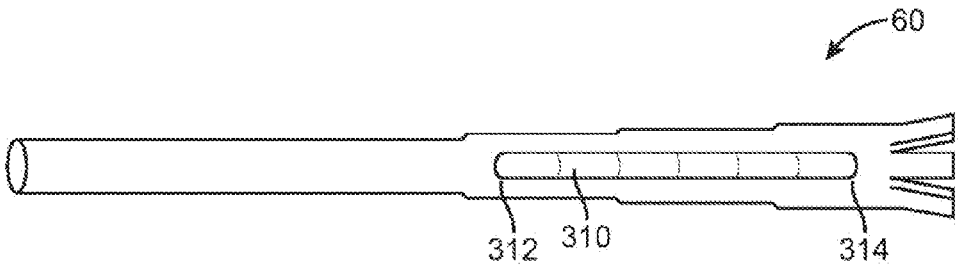
FIGS. 20A-20C are cross sectional views of the adjustable length and torque resistant golf shaft of FIG. 19 in accordance with an exemplary embodiment.
Figure 20B:
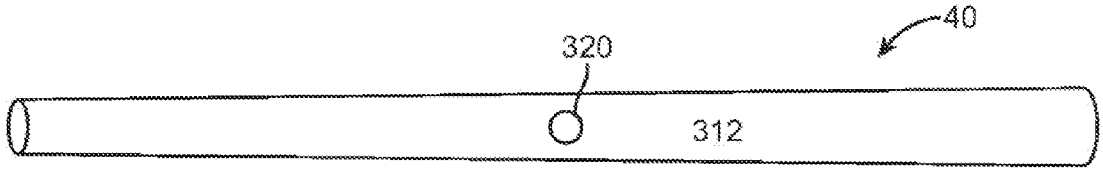
Figure 20C:
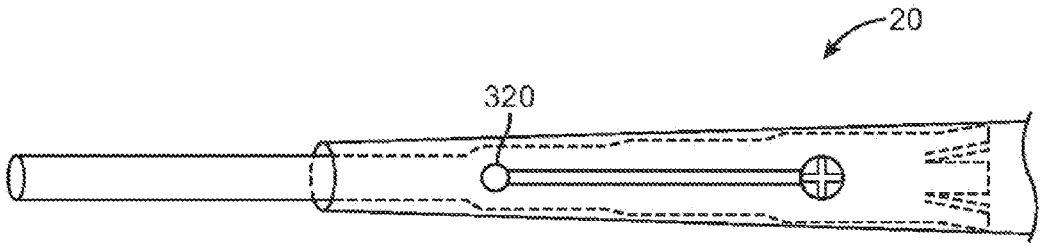

FIGS. 20A-20C are cross sectional views of the adjustable length and torque resistant golf shaft of FIG. 19 in accordance with an exemplary embodiment. In accordance with an exemplary embodiment as shown in FIG. 20A, the lower shaft member 60 has a groove or slot 310, which extends from approximately a mid-point or mid-section of the lower shaft member 60 towards the flared end of the lower shaft member 60. The groove or slot 310 has a distal end 312 and a proximal end 314 having a depth of approximately 0.01 inch to 0.25 inches. It can be appreciated that the groove or slot 310 can also include a variable depth to provide indentations to assist the fastener 300 in securing the upper shaft member 40 to the lower shaft member 60. In addition, the grove or slot 310 also assists with preventing any rotation between the upper shaft member 40 and the lower shaft member 60. In accordance with an exemplary embodiment, the lower shaft member 60 is approximately 22 inches in length, and the distal end 312 of the groove or slot 310 is approximately 12.25 inches from the distal end of the lower shaft member 60. The groove or slot 310 preferably extends approximately 9.75 inches from distal end 312 to the proximal end 314.

FIG. 20B is a cross sectional view of the upper shaft member 40 having an opening or hole 320, which is configured to receive the fastener 300. In accordance with an exemplary embodiment, a center point of the opening or hole 320 is approximately 12 inches from the distal end of the upper shaft member 40 and 13.5 inches from the proximal end of the upper shaft member 40 for an upper shaft member 40 having an overall length of approximately 25.5 inches.

FIG. 20C is a cross sectional view of shaft 20 showing the upper shaft member 40 and the lower shaft member 60 in an assembled position. As shown in FIG. 20C, the shaft 20 has an overall length of approximately 35.5 inches in a fully extended position and can be shortened to approximately 26 inches based on a 9.75 inch slot or groove 310. It can be appreciated that although the slot or groove is 9.75 inches, the length of the shaft 20 from a fully extended to a fully compress length will typically be less than the 9.75 inches as a result of the diameter of the fastener and other variables.

Figure 20D:
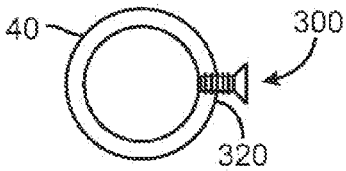
FIGS. 20D-20E are end views of the adjustable length and torque resistant golf shaft of FIG. 19 in accordance with an exemplary embodiment.
Figure 20E:
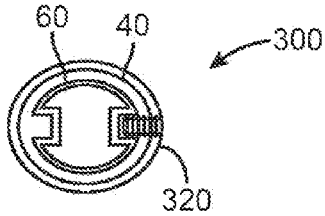

FIGS. 20D-20E are end views of the adjustable length and torque resistant golf shaft of FIG. 19 in accordance with an exemplary embodiment. As shown in FIG. 20D, the upper shaft member 40 has a generally oval outer diameter with an opening or hole 320 configured to receive a fastener 300 preferably in the form of a screw or similar type device. In accordance with an exemplary embodiment, the fastener 300 is a screw having a hexagonal head (i.e., hex screw). As shown in FIG. 20E, the lower shaft member 60 includes at least one groove or slot 310, which is configured to receive a fastener 300 in the form of a screw or other suitable device to secure the lower shaft member 60 to the upper shaft member 40. It can be appreciated that as shown in FIG. 20E, the lower shaft member 60 can include one or more grooves or slots 310. For example, as shown in FIG. 20E, the lower shaft member 60 can include a pair (or two) slots or grooves, which are 180 degrees from one another. It can be appreciated that the lower shaft member 60 can include 3 or 4 slots or grooves extending longitudinally along the lower shaft member 60, and which are 120 or 90 degrees to one another, respectively.

Figure 21A:
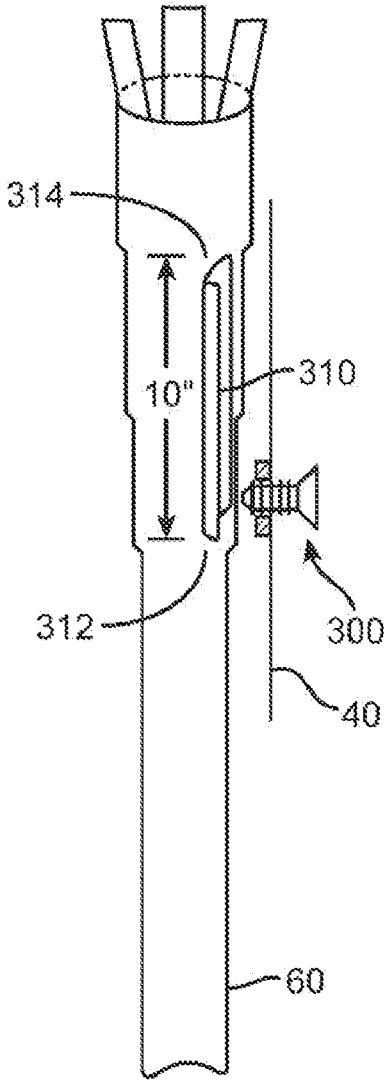
FIGS. 21A-21B are cross sectional views of an adjustable length and torque resistant golf shaft in accordance with an exemplary embodiment.
Figure 21B:
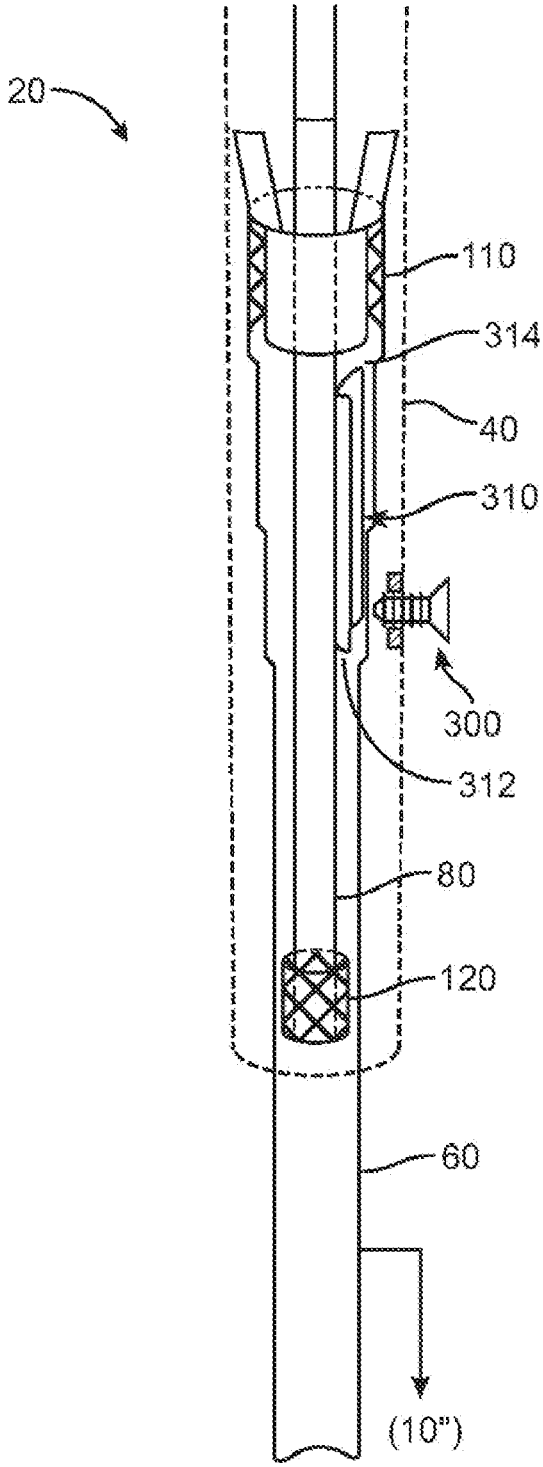

FIGS. 21A-21B are cross sectional views of an adjustable length and torque resistant golf shaft in accordance with an exemplary embodiment. As shown in FIGS. 21A-21B, the lower shaft member 60 has a groove or slot 310, which extends from approximately a mid-point or mid-section of the lower shaft member 60 towards the flared end of the lower shaft member 60. The groove or slot 310 has a distal end 312 and a proximal end 314 having a depth of approximately 0.01 inches to 0.25 inches, and more preferably approximately 0.100 inches to 0.125 inches. It can be appreciated that the groove or slot 310 can also include a variable depth to provide indentations to assist the fastener 300 in securing the upper shaft member 40 to the lower shaft member 60. In addition, the grove or slot 310 also assists with preventing any rotation between the upper shaft member 40 and the lower shaft member 60. In accordance with an exemplary embodiment, the groove or slot 310 is approximately 10 inches in length from the distal end 312 to the proximal end 314.

Figure 22A:
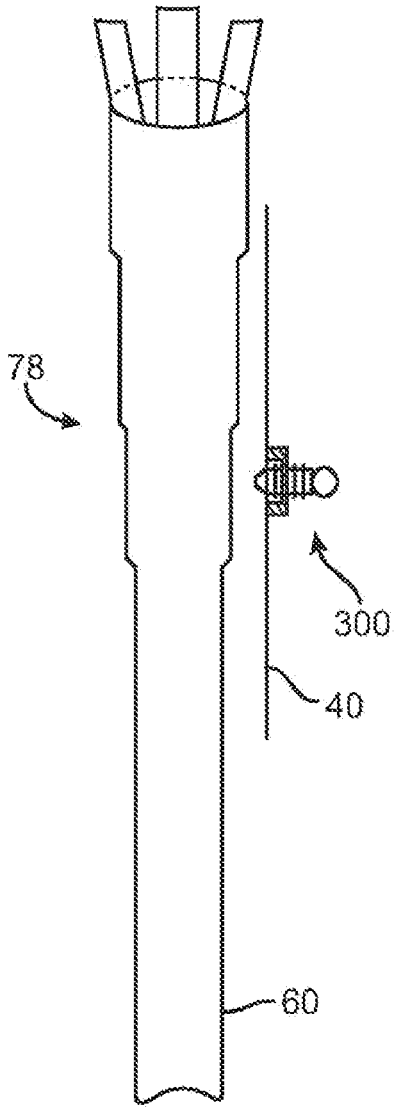
FIGS. 22A-22B are cross sectional views of an adjustable length and torque resistant golf shaft in accordance with another exemplary embodiment.
Figure 22B:
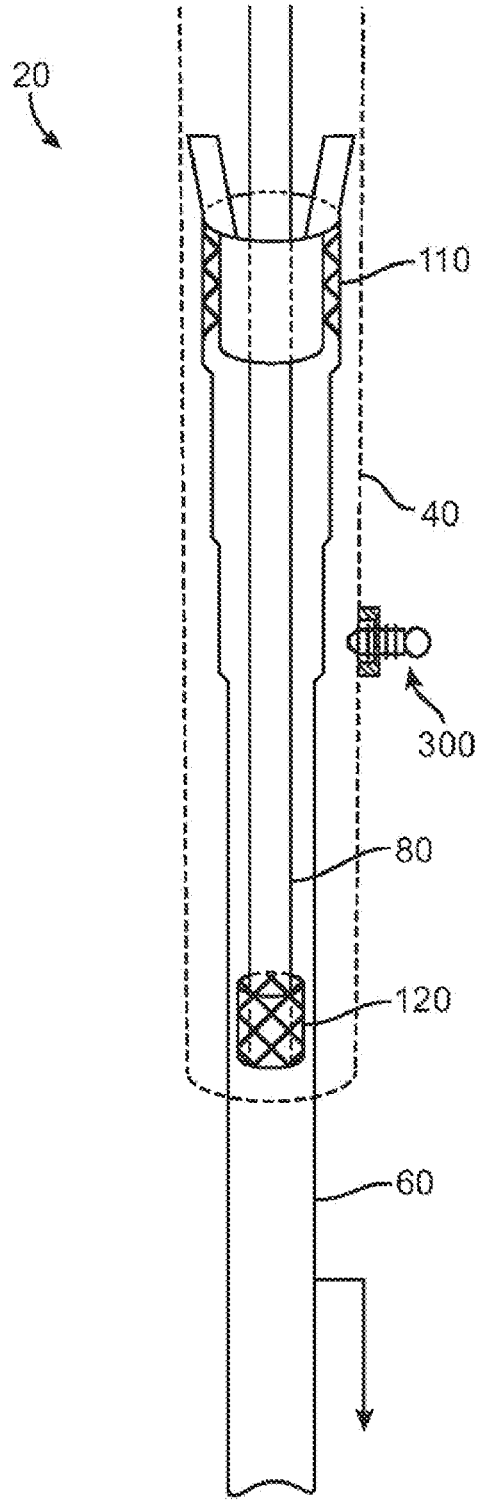

FIGS. 22A-22B are cross sectional views of an adjustable length and torque resistant golf shaft in accordance with another exemplary embodiment. As shown in FIGS. 22A-22B, the fastener or screw 300 secures the length of the shaft 20 upon ascertainment of a desired length for use. As shown in FIGS. 22A-22B, the lower shaft member 60 has a stepped outer surface 78, which assists with securing the shaft upon the determination of the desired length and with preventing the lower shaft member 60 from rotating within the upper shaft member 40.

Figure 23:
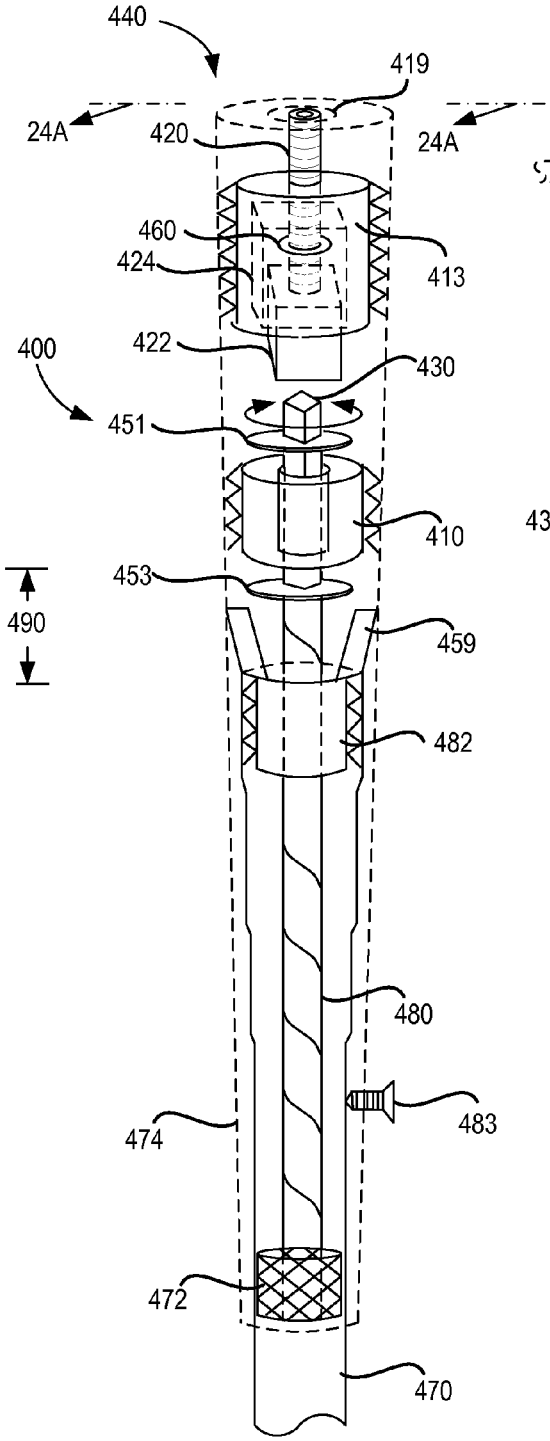
FIG. 23 is a cross sectional view of an adjustable length and torque resistant golf shaft having an inner locking mechanism in accordance with an exemplary embodiment.
Figure 24A:
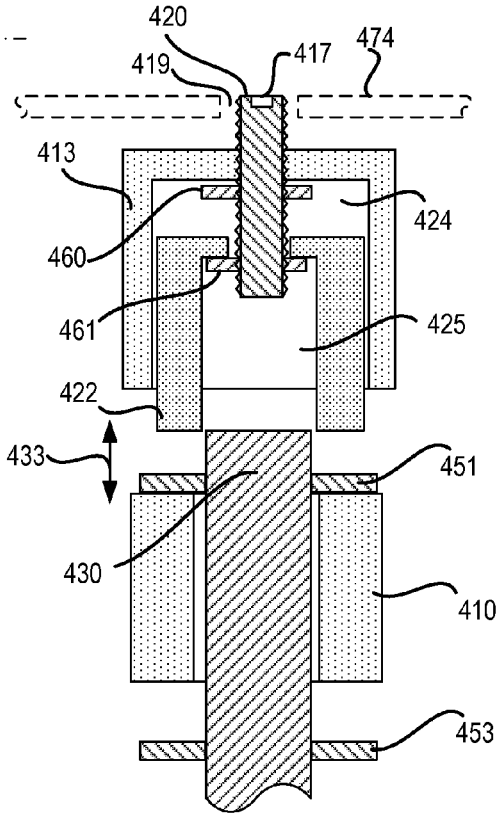
FIG. 24A is an enlarged cross sectional view of a portion of the golf shaft in FIG. 23, taken along the line 24A in FIG. 23.

FIG. 23 is a cross sectional view of an adjustable length and torque resistant golf shaft 400 having an inner locking mechanism 440 in accordance with an exemplary embodiment. FIG. 24A is an enlarged cross sectional view of a portion of the golf shaft 400 in FIG. 23, taken along the line 24A in FIG. 23. For brevity, the putter head, such as 14 in FIG. 1, and ball strike portion, such as 16, are not shown in FIG. 23, even though these components are to be attached when the user uses the shaft for play. As shown in FIGS. 23 and 24A, the putter includes an adjustable shaft 400, which is comprised of an upper shaft member 474 (or outer shaft member), a lower shaft member 470 (or inner shaft member) and an inner rod 480. The shaft 400 includes an upper bushing 410, which is fixed within the upper shaft member 474, a middle bushing 482 fixed within the lower shaft member 470 and a lower bushing 472 slidably and rotatably mounted in the lower shaft member 470. The lower end of the inner rod 480 is fixed to the lower bushing 472. In accordance with an exemplary embodiment, the entire portion of the inner rod 480 is preferably a rectangular rod, and has a form of a twisted or helical rod, except the portion 430 near the top thereof. It can be appreciated that the inner rod 480 preferably has a rectangular cross section, however, other cross-sectional shapes including round or elliptical can be used.

In accordance with an embodiment, the shaft 400 includes an inner locking mechanism 440, which fits within the upper shaft member 474 and can be accessed through a hole 419 formed on the top of upper shaft member 474 and a grip (not shown in FIG. 23 for brevity). As shown in FIG. 23, the inner locking mechanism 440 includes a locking bushing 413 fixed within the upper shaft member 474 and an upper bushing 410, which is fixed within the upper shaft member 474. The middle bushing 482 is generally cylindrical in shape and includes an opening or bore extending from a first end to a second end of the middle bushing 482. In accordance with an embodiment, rather than a straight or cylindrical bore, the bore in the middle bushing 482 includes a helical design or shape to accommodate the helical shaped inner rod 480. When the inner rod 480 is rotated relative to the middle bushing 482, the inner rod 480 moves in the vertical direction relative to the middle bushing 482 due to the helical shape thereof. Since the middle bushing 482 is fixed to the lower shaft member 470, the inner rod 480 moves in the vertical direction relative to the lower shaft member 470 only when the inner rod 480 is rotated relative to the lower shaft member 470.

In accordance with an embodiment, the inner rod 480 can extend up and through the bore of the upper bushing 410 into an upper portion of the upper shaft member 474. The diameter of the bore of the upper bushing 410 is larger than the dimension of the inner rod 480 so that the inner rod 480 can freely rotate relative to the upper bushing 410 when the user loosens the screw 420. The upper bushing 410 is preferably round or cylindrical as shown in FIG. 23. In accordance with an exemplary embodiment, a pair of washers 451, 453 are fixed to the inner rod 480 and their positions are set to determine the upper and lower limits of the vertical motion of the inner rod 480 relative to the upper bushing 410.

The locking mechanism 440 also includes a threaded screw or bolt 420, which upon tightening, locks the inner rod 480 within the upper shaft member 474 relative to the upper bushing 410. The threaded screw or bolt 420 is positioned on an upper end of the shaft 400 and fits within the grip of the shaft 400. It can be appreciated that in accordance with an exemplary embodiment, the threaded screw or bolt 420 is a hex screw or bolt having a length of approximately 0.5 to 1.5 inches and more preferably a length of approximately 1.0 inches. In accordance with an exemplary embodiment, the threaded screw or bolt 420 includes a head 417, which receives a tool such as a screw driver, wrench (i.e., Alley key or wrench and/or socket wrench) and which turns the threaded screw through the female threads formed in the locking bushing 413. In accordance with an exemplary embodiment, the threaded screw or bolt 420 preferably is tightened using a hex key of approximately 1/16 to 1/2 of an inch, and most preferably approximately 3/32 of an inch.

As depicted in FIGS. 23 and 24A, the locking bushing 413 has a generally cylindrical shape and includes an inner rectangular cavity 424. A square busing 422 is disposed within the cavity 424, where the dimension of the cavity 424 is slightly larger than that of the outer dimension of the square bushing 422 so that the square bushing can slide in the vertical direction relative to the locking bushing 413. The square bushing 422 includes a cavity 425, where the cavity 425 is shaped to accommodate the top portion 430 of the inner rod 480. The dimension of the top portion 430 of the inner rod 480 is slightly smaller than that of the cavity 425 so that the top portion 430 of the inner rod can slide in the vertical direction relative to the square bushing 422, but cannot rotate relative to the square bushing 422 when fully engaged into the cavity 425.

Figure 24B:
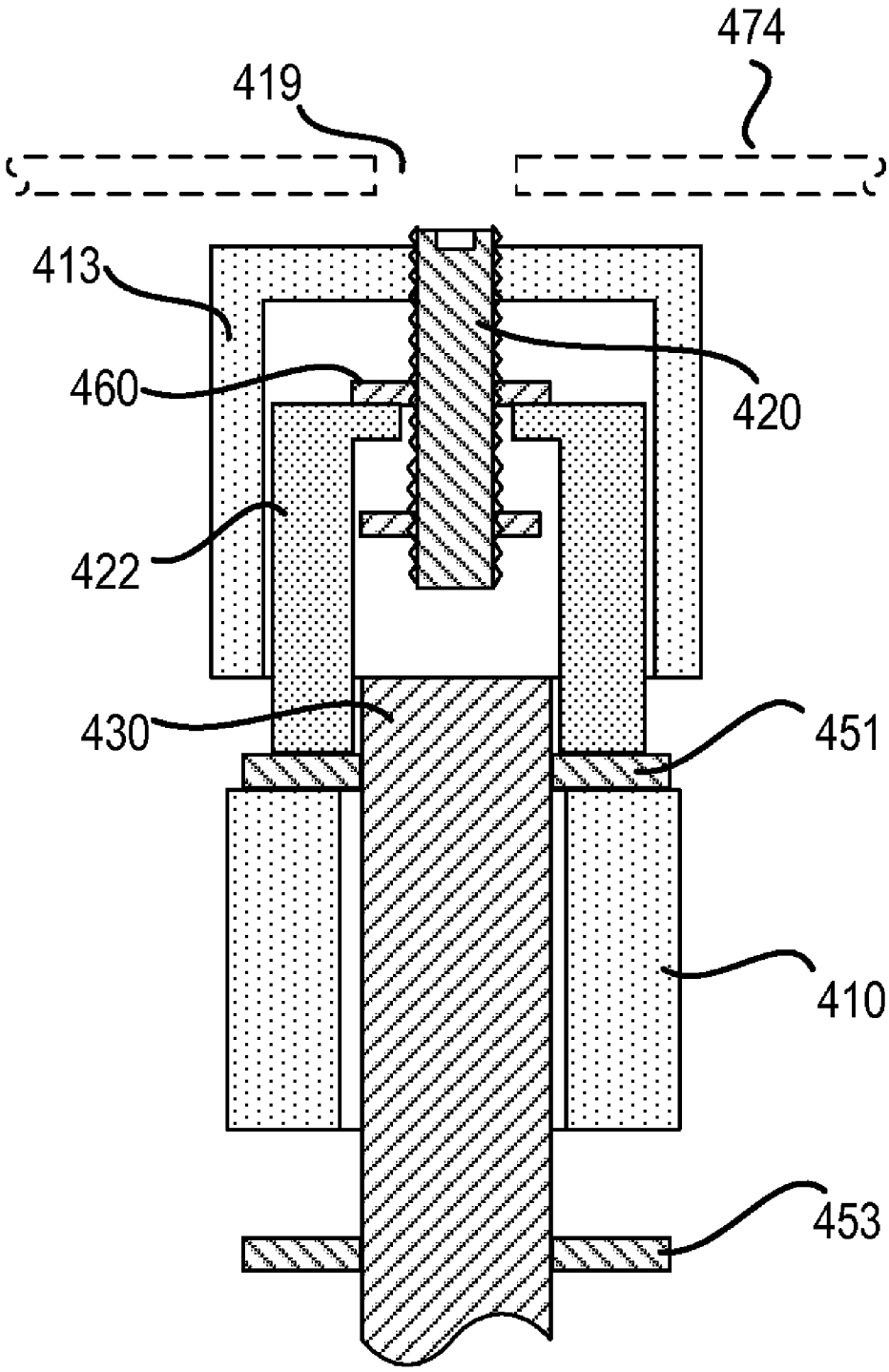
FIG. 24B is an enlarged cross sectional view of a portion of the golf shaft in FIG. 23, taken along the line 24A in FIG. 23.

Two washers 460, 461 are secured to the screw 420, where the square bushing 422 is suspended on the lower washer 461 when the top portion 430 of the inner rod 480 is not fully engaged, as shown in FIG. 24A. The head 417 of the screw 420 may be substantially at the same level as the top portion of the upper shaft member 474 when the screw 420 is at its top position. As the user tightens the screw 420, the screw 420 and the square bushing 422 advance in the downward direction (as indicated by an arrow 433) so that the top portion 430 of the inner rod engages into the cavity 425. FIG. 24B is an enlarged cross sectional view of a portion of the golf shaft 400 in FIG. 23, where the top portion 430 of the inner rod is fully engaged into the cavity 425 of the square bushing 422. The top washer 460 fixed to the screw 420 applies the downward force against the washer 451, and the washer 451 in turn applies the downward force against the upper bushing 410. Then, the friction between the washer 451 and the upper bushing 410 prevents the inner rod 480 from rotating relative to the upper bushing 410, providing a locking mechanism that prevents the inner rod 480 from rotating relative to the upper bushing 410. As discussed above, the inner rod 480 moves relative to the lower shaft member 470 in the vertical direction only when the inner rod 480 is rotated relative to the lower shaft member 470. Thus, the locking mechanism prevents the lower shaft member 470 from moving relative to the upper shaft member 474 when the user tightens the screw 420, causing the length of the shaft 400 to be fixed. The flares 459 also prevent the lower shaft member 470 from sliding relative to the upper shaft member 474. Since the function and shape of the flares 459 are similar to those of the flares in FIG. 1, the detailed description of the flares 459 is not repeated for brevity.

The lower shaft member 470 may be secured to the upper shaft member 474 by a suitable fastening mechanism, such as a screw 483. Since the function, shape, and dimension of the screw 483 may be similar to those of the screw 300, the detailed description of the screw 483 is not repeated. Alternatively, the fastening mechanisms, such as 310, described in conjunction with FIGS. 19-22B can be also used to secure the lower shaft member 470 to the upper shaft member 474.

As the adjustable shaft 400 is compressed and/or extended, the distance between the upper bushing 410 and the middle bushing 482 changes. For example, as the shaft 400 extends, the distance 490 between the upper bushing 410 and the middle bushing 482 increases. Alternatively, as the shaft 400 is compressed, the distance 490 between the rotatable upper bushing 410 and the middle bushing 482 decreases. However, with the embodiments as shown in FIGS. 23 and 24A-B, in order to lock or fix the relative distance between the respective bushings 410, 482, 413, the lower shaft member 470 and the upper shaft member 474, the screw 420 is tightened onto an upper portion of the locking bushing 413, which fixes (or sets) the relative distances between the respective bushings 410, 482, 413, the lower shaft member 470 and the upper shaft member 474 by preventing the inner rod 480 from rotating within the middle bushing 482. It can be appreciated that by preventing the inner rod 480 from rotating within the middle bushing 482, the distance or length of the shaft 400 can be fixed.

It is noted that the cavity 424 formed in the locking bushing 413 is shown to have a generally rectangular shape. However, the cavity may have other general shape, such as circle, oval, etc., as long as the outer dimension of the square bushing 422 conforms to dimension of the cavity 424. Also, the cavity 425 formed in the square bushing 422 may have any other suitable share, such as triangle or polygon, so long as the cavity 425 can accommodate the top portion of 430 of the inner rod 480 and the inner rod 480 cannot rotate relative to the square bushing 422 when it is fully engaged into the cavity 425.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. An adjustable shaft, comprising:

an upper shaft member having an elongated bore therein with a fixed upper bushing positioned within an upper end of the elongated bore therein;

a lower shaft member having an elongated bore therein with a middle bushing fixed within an upper end of the elongated bore therein, the middle bushing having an elongated bore extending through the middle bushing;

a helical inner rod having a lower bushing fixed to a lower end thereof, the bore of the middle bushing having a helical shape to accommodate the inner rod therethrough and to move the middle bushing relative to the upper bushing upon rotating the helical inner rod within the middle bushing; and a locking mechanism adapted to prevent the helical inner rod from rotating within the middle bushing, to thereby fix a total length of the shaft, wherein the locking mechanism comprises a threaded screw, which is positioned within an upper portion of the upper shaft member and prevents the helical inner rod from rotating relative to the upper bushing upon tightening thereof.

2. The adjustable shaft of claim 1, further comprising a locking bushing, wherein the locking bushing includes a female thread configured to accommodate the threaded screw.

3. The adjustable shaft of claim 2, wherein the locking bushing has a cavity, further comprising:

an additional bushing configured to slide within the cavity and to prevent the inner rod from rotating relative to the upper bushing upon tightening the threaded screw.

4. The adjustable shaft of claim 3, wherein the additional bushing includes a cavity configure to accommodate a top portion of the helical inner rod.

5. The adjustable shaft of claim 1, further comprising two washers fixed to the threaded screw.

6. The adjustable shaft of claim 1, further comprising two washers fixed to the helical inner rod.

7. The adjustable shaft of claim 1, wherein the helical inner rod has a rectangular cross-section.

8. The adjustable shaft of claim 1, wherein a distance between the middle bushing and the upper bushing changes as the length of the shaft increases or decreases.

9. The adjustable shaft of claim 1, wherein the lower shaft member has a lower portion and an upper portion, the upper portion has a stepped portion, wherein the stepped portion results in the upper end of the lower shaft member having a greater outer diameter than an outer diameter of the lower end of the lower shaft member.

10. The adjustable shaft of claim 1, wherein the upper end of the lower shaft member has a flared end, wherein the flared end is configured to fit within an inner surface of the upper shaft member.

11. The adjustable shaft of claim 1, further comprising a putter head attached to the lower shaft member.

12. The adjustable shaft of claim 1, further comprising a screw that secures the lower shaft member to the upper shaft member and is disposed on a side of the shaft.

* * * * *